United States Patent [19]

Hintsch

[11] 4,325,520

[45] Apr. 20, 1982

[54] APPARATUS FOR STORING FILAMENTARY MATERIAL

[75] Inventor: Otto Hintsch, Wallisellen, Switzerland

[73] Assignee: Sulzer Brothers Limited, Winterthur, Switzerland

[21] Appl. No.: 194,423

[22] Filed: Oct. 6, 1980

Related U.S. Application Data

[63] Continuation of Ser. No. 6,915, Jan. 26, 1979, abandoned.

[30] Foreign Application Priority Data

Jan. 31, 1978 [CH] Switzerland ..... 1024/78

[51] Int. Cl.³ ..... B65H 51/20

[52] U.S. Cl. ..... 242/47.01; 250/234; 250/522; 250/548; 250/571

[58] Field of Search ..... 242/47.01–47.13; 139/452; 250/234, 239, 522, 548, 571, 561; 248/176, 177, 178, 298, 310, 424, 429, 430, 651, 655, 656; 33/143 K, 252, 254, 258

[56] References Cited

U.S. PATENT DOCUMENTS

| | | | |
|---|---|---|---|
| 717,478 | 12/1902 | Wesson | 33/252 |
| 860,429 | 7/1907 | Windridge et al. | 33/258 |
| 1,451,584 | 4/1923 | Mapes | 33/258 |
| 2,521,934 | 9/1950 | Mitchell | 33/143 K |
| 2,755,053 | 7/1956 | Sloane | 248/179 |
| 3,060,584 | 10/1962 | Westfall | 33/143 K |
| 3,737,112 | 6/1973 | Tellerman et al. | 242/47.01 |
| 3,818,598 | 6/1974 | Hershire | 33/143 K |

FOREIGN PATENT DOCUMENTS

| | | | |
|---|---|---|---|
| 2307900 | 11/1976 | France | 139/452 |

*Primary Examiner*—Stanley N. Gilreath
*Attorney, Agent, or Firm*—Kenyon & Kenyon

[57] ABSTRACT

The means for storing filamentary material comprises a U-shaped guide, a support which is slidable in the guide and a sensing element, e.g. a light source, which is carried on the support for the coil of yarn being stored. The support and the sensing element are very easily and accurately adjustable and retain the position to which they have been adjusted even during operation and are protected from vibration. Adjustment is facilitated by a fine adjustment means comprising teeth and a gear wheel meshing therein, so that the sensing element can first be moved manually (coarse adjustment) and thereafter be accurately moved into the required end position by means of the gear wheel and teeth (fine adjustment).

3 Claims, 3 Drawing Figures

APPARATUS FOR STORING FILAMENTARY MATERIAL

This is a continuation of application Ser. No. 6,915 filed Jan. 26, 1979, now abandoned.

This invention relates to an apparatus for storing filamentary material. More particularly, this invention relates to a yarn storage apparatus.

As is known, various types of devices have been used for storing filamentary material such as yarn, wire, strip, and the like. In many cases, the devices have been constructed with a substantially cylindrical bobbin on which the material is wound and a means for controlling the axial length of the winding on the bobbin. Generally, the means for controlling the axial length of the winding includes a sensing element which is adjustable along the length of the bobbin so as to detect the presence or absence of the windings on the bobbin at a given point.

In order to permit adjustment of the control means, it has been known to mount the sensing element for displacement on two rods which extend parallel to the axis of the bobbin and to use a screw spindle to adjust the sensing element along the rods. Use is also made of a lock-nut to lock the sensing element in a given position. However, in such cases, it has sometimes been difficult to bring the sensing element into the exact position, for example if corrosion has occured on the rods or if the sensing element is out of true for some reason during adjustment. For instance, the sensing element or its support may be jammed on the rods so that the sensing element may only be guided out of its prior position by use of a strong percussive force. The parallel rods may thus become easily slightly bent or canted so that it is more difficult to bring the sensing element into a new precise position. Corrosion of the rods can also be a hinderance and can result in the rods being bent during adjustment.

Finally, in the known embodiments, machine vibrations which form during operation may reach the rods supporting the sensing element and cause the rods and sensing element to also vibrate. This makes an exact control of the winding length of the storage device difficult during operation.

Accordingly, it is an object of this invention to provide a storage apparatus which can be easily and readily adjusted.

It is another object of the invention to provide a yarn storage apparatus in which a sensing element is not unduly effected by vibrations during operation.

It is another object of the invention to provide a simple means of mounting a sensing element for a yarn storage apparatus for ready adjustment.

Briefly, the invention provides an apparatus for storing filamentary material which is comprised of a substantially cylindrical bobbin for receiving a plurality of windings of filamentary material and a means for controlling the axial extent of the windings on the bobbin, wherein the means includes a sensing element for detecting the presence of a winding at a predetermined point on the bobbin. In addition, the apparatus includes a U-shaped guide beam of U-shaped cross-section which is positioned along the bobbin and a support which is slidably mounted in the guide and has the sensing element secured thereto. The support is movable in the guide beam so as to adjust the sensing element relative to the bobbin and, thus, permit adjustment of the point at which the presence of a winding is to be detected.

In this arrangement, the support and, hence, the sensing element can be slid very easily and accurately into the required position which can then be retained exactly during operation. In particular, an especially stable mounting of the sensing element is achieved not only during adjustment but also after the sensing element has been set in position during operation. A U-shaped construction can practically not be bent out of shape and direction during adjustment. Further, it is practically impossible to make the guide vibrate during operation of the apparatus.

In one embodiment, the U-shaped guide beam is provided with an anti-friction insert, preferably of plastics, at least on one of a plurality of inner walls of the guide beam for sliding of the support thereon. In this way, the adjustment of the support within the guide beam can be facilitated. At the same time, vibrations which occur during operation can be damped by means of the insert.

The guide beam which has a pair of limbs for guiding the support therebetween has a bend at the free end of each limb which is directed towards an opposite limb for holding the support within the guide beam.

The arrangement of the support within the guide beam can be used to provide a coarse adjustment while a fine adjustment is provided with the use of a suitable adjustment means. For example, the adjustment means for adjusting the support longitudinally of the guide beam may include a plurality of teeth on one of the guide beam or support and a gear wheel on the other of the guide beam or support. In this case, the gear wheel is mounted for rotation on a fixed axis while being in meshing engagement with the teeth. In order to effect an adjustment, the sensing element can first be easily manually engaged and moved towards a predetermined point with a final accurate adjustment being thereafter readily obtained by means of the gear wheel.

These and other objects and advantages of the invention will become more apparent from the following detailed description taken in conjunction with the accompanying drawings wherein.

Figure 1:
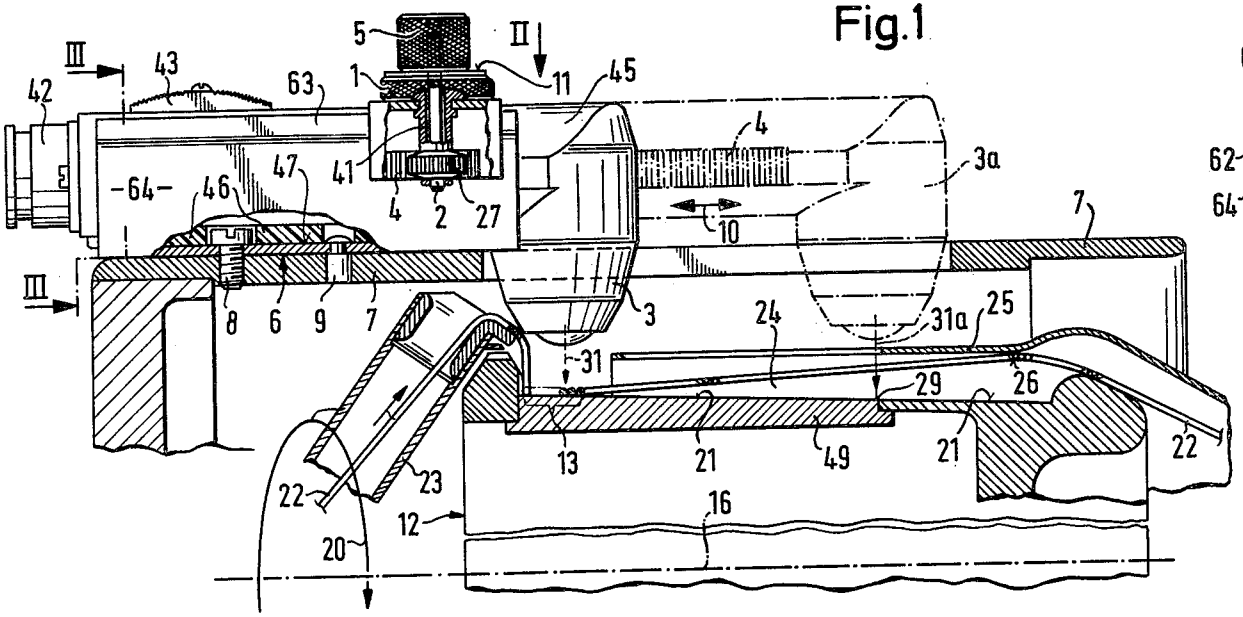
FIG. 1 illustrates a cross-sectional view through the main parts of storage apparatus constructed in accordance with the invention.

Referring to FIG. 1, the apparatus for storing a filamentary material, such as a weft yarn for a weaving machine includes a substantially cylindrical bobbin 12 which is mounted in fixed manner about an axis 16. As is known, this bobbin 12 has a periphery 21 which is of generally slight conical shape so as to receive a plurality of windings 13 of a yarn 22. As shown, the yarn 22 is supplied by a rotating feed tube 23 which rotates about the bobbin 12 in the direction indicated by the arrow 20. The yarn 22 is drawn off the bobbin 12 through a gap 24 which is formed between the bobbin 12 and a cylindrical part 25 which forms a means of limiting the balloon 26 of the yarn which is formed during the removal process.

The apparatus also has a means for controlling the axial extent of the windings 13 on the bobbin 12. This means includes a sensing element which is in the form of a light source 3 to detect the presence (or absence) of a winding at a predetermined point on the bobbin 12. This light source 3 cooperates with a reflective strip 49 which is mounted in the periphery 21 of the bobbin 12. To this end, the light source 3 directs a beam of light 31 at the windings 13 which are wound about a reflective strip 49 on the bobbin 12.

Figure 2:
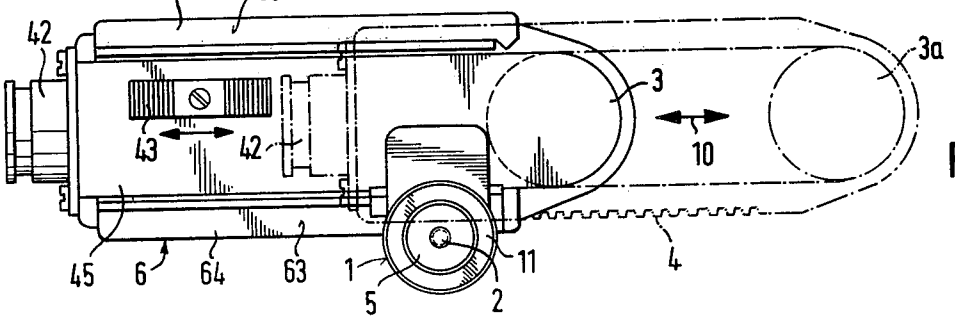
FIG. 2 illustrates a view of the apparatus of FIG. 1 taken in the direction of arrow II in FIG. 1.

Referring to FIGS. 1 and 2, the light source 3 is secured in depending manner to a support 45 which, in turn, is slidably received in a guide beam 6 of U-shaped cross-section for reciprocation in the direction indicated by the arrow 10 so as to adjust the light source 3 longitudinally of the bobbin 12. The U-shaped guide beam 6 is secured to a machine frame 7 extending over the bobbin 12 via a clamping screw 8 and a rivet 9.

Figure 3:
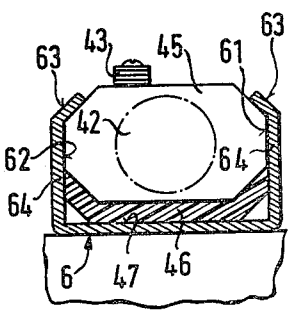
FIG. 3 illustrates a view taken on line III—III of FIG. 1.

As shown in FIG. 3, the U-shaped guide beam 6 has a pair of outstanding limbs 64 for guiding the support 45 therebetween. Each of these limbs 64 has a bend 63 at a free end which is directed towards an opposite limb 64 for holding the support 45 within the guide 6. As indicated, the bends 63 serve to prevent the support 45 from lifting out of the guide beam 6. In addition, an antifriction insert 46 which is made of plastics, for example, nylon, is disposed within the guide 6 on the bottom wall 47. This insert 46 is shaped to the support 45 so as to facilitate sliding of the support 45 within the guide beam 6.

As shown in FIG. 2, the support 45 has an electrical connection 42 and a switch 43 for activating the light source 3.

Referring to FIGS. 1 and 2, the guide beam 6 carries a housing in which a hollow shaft 41 (FIG. 1) is mounted for rotation about a fixed axle 2. The hollow shaft 41 carries an adjusting wheel 1 at the upper end and a gear wheel 27 at the lower end which engages with a plurality or rack of teeth 4 on one sidewall of the support 45. As illustrated, a knurled nut 5 is threaded onto the upper end of the axle 2 and a washer 11 is disposed between the nut 5 and the adjusting wheel 1. By tightening the nut 5 on the axle 2, the adjusting wheel 1 can be locked in place.

When the knurled nut 5 is loosened, the support 45 and light source 3 can be manually pulled out of or pushed into the guide 6 in the direction indicated by the arrow 10 (coarse adjustment). The adjusting wheel 1 can then be turned to rotate the gear wheel 27 so that the teeth 4, and thus the support 45 and light source 3 are moved (fine adjustment). For example, in order to bring the light source 3 into the end position 3*a* shown in chain dotted lines in FIG. 1, the nut 5 is loosened, the support 45 moved manually towards the end position 3*a* and the adjustment wheel 1 rotated to bring the light source into the position 3*a*. In this position, the beam of light 31 impinges on a point 29 on the bobbin 12 which is situated farther to the right than the position shown in solid line. As a result, the winding of yarn is much longer, as viewed, in the direction of the axis 16 of the bobbin and the amount of yarn which is stored is increased. In order to decrease the amount of storage, the light source 3 is moved in the opposite direction, i.e. to the left as viewed.

Alternatively, the gear wheel 27 may be situated on the support 45 for the light source 3 while the teeth 4 are provided on the guide beam 6.

Further, the antifriction insert 46 may also be provided on one of the other inner walls of the guide beam 6, for example on the side walls 61, 62 on the limbs 64. Also, the insert 46 may be made of an elastic material such as rubber.

Still further, an inductive signal transmitter or the like may be used as the sensing element instead of the light source 3.

What is claimed is:

1. An apparatus for storing filamentary material, said apparatus comprising a substantially cylindrical bobbin for receiving a plurality of windings of filamentary material thereon;

a frame extending over said bobbin;

means for controlling the axial extent of the windings of filamentary material on said bobbin, said means including a sensing element for detecting the presence of a winding at a predetermined point on said bobbin;

a guide beam of U-shaped cross-section secured to said frame and having a pair of outstanding limbs positioned over said bobbin;

a support slidably mounted in said guide beam between and within said limbs and having said sensing element secured thereto in depending relation, said support being movable in and along said guide beam to adjust said sensing element relative to said bobbin whereby to adjust said point; and an adjustment means for adjusting said support longitudinally of said guide beam, said adjustment means including a plurality of teeth on one of said guide beam and said support and a gear wheel on the other of said guide beam and said support, said gear wheel being mounted for rotation on a fixed axle and in engagement with said teeth and a nut threaded on said axle for locking said gear wheel in place upon tightening of said nut towards said gear wheel.

2. An apparatus as set forth in claim 1 which further comprises an anti-friction insert in said guide beam at least on one of a plurality of inner walls of said guide beam for sliding of said support thereon.

3. An apparatus as set forth in claim 1 wherein each said limb has a bend at a free end directed towards an opposite limb for holding said support within said guide.

* * * * *